US011529817B2

(12) United States Patent
Inoue

(10) Patent No.: US 11,529,817 B2
(45) Date of Patent: Dec. 20, 2022

(54) PAPER CONVEYANCE DEVICE AND PRINTER

(71) Applicant: TOSHIBA TEC KABUSHIKI KAISHA, Tokyo (JP)

(72) Inventor: Yoshimasa Inoue, Soka Saitama (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 221 days.

(21) Appl. No.: 17/099,962

(22) Filed: Nov. 17, 2020

(65) Prior Publication Data

US 2021/0394535 A1 Dec. 23, 2021

(30) Foreign Application Priority Data

Jun. 17, 2020 (JP) ..... JP2020-104830

(51) Int. Cl.

| | |
|---|---|
| ***B41J 11/66*** | (2006.01) |
| ***B65H 20/02*** | (2006.01) |
| ***B41J 13/00*** | (2006.01) |
| ***B41J 3/30*** | (2006.01) |
| ***B65H 35/00*** | (2006.01) |
| ***B41J 3/60*** | (2006.01) |

(52) U.S. Cl.

CPC ..... *B41J 11/663* (2013.01); *B41J 3/30* (2013.01); *B41J 3/60* (2013.01); *B41J 13/009* (2013.01); *B41J 13/0045* (2013.01); *B41J 13/0054* (2013.01); *B65H 20/02* (2013.01); *B65H 35/0093* (2013.01)

(58) Field of Classification Search

CPC ..... B41J 11/663; B41J 3/30; B41J 3/60; B41J 13/0045; B41J 13/0054; B41J 13/009; B65H 20/02; B65H 35/0093

See application file for complete search history.

(56) References Cited

U.S. PATENT DOCUMENTS

| | | | | |
|---|---|---|---|---|
| 2019/0160835 | A1* | 5/2019 | Sumii | B41J 11/04 |
| 2019/0176496 | A1* | 6/2019 | Nihashi | B65H 29/58 |

* cited by examiner

*Primary Examiner* — Henok D Legesse

(74) *Attorney, Agent, or Firm* — Amin, Turocy & Watson, LLP

(57) ABSTRACT

According to one embodiment, a paper conveyance device includes a conveyance unit configured to convey long cut paper in a longitudinal direction, a measuring unit configured to measure a length of the cut paper in the longitudinal direction, which is conveyed by the conveyance unit, a reversal mechanism that reverses a front surface and a back surface to each other with conveying the cut paper, and a reversal unit configured to convey the cut paper in the reversal mechanism. The reversal unit conveys the cut paper at a first speed when the measuring unit measures that the length of the cut paper is less than a predetermined length, and conveys the cut paper at a second speed slower than the first speed when the measuring unit measures that the length of the cut paper is equal to or more than the predetermined length.

20 Claims, 12 Drawing Sheets

243

| 2431 LENGTH L OF CHECK (mm) | 2432 CONVEYANCE SPEED(IPS) |
|---|---|
| LESS THAN 200 | 16 |
| 200 OR MORE | 6 |

PAPER CONVEYANCE DEVICE AND PRINTER

CROSS-REFERENCE TO RELATED APPLICATION

This application is based upon and claims the benefit of priority from Japanese Patent Application No. 2020-104830 filed Jun. 17, 2020, the entire contents of which are incorporated herein by reference.

FIELD

Embodiments described herein relate generally to a paper conveyance device and a printer.

BACKGROUND

For example, in a printer used as a printing apparatus for a sheet-like cut paper such as checks, bills, or tickets, the cut paper inserted from a medium entrance and exit is drawn into the apparatus to print predetermined items, and then is discharged from the same medium entrance and exit.

The date of use of a check, the number of a point-of-sales (POS) terminal that handles the check, an assigned person, and the like are printed on one or both sides of such a check or a bill. When printing is performed on both sides of a check, it is necessary to reverse the front surface and the back surface to each other. Thus, such a printer includes a reversal mechanism that reverses the front surface and the back surface of the check to each other. The front surface and the back surface of the check or the like are conveyed in the reversal mechanism to be reversed to each other.

In order to reverse the front surface and the back surface of a check to each other in the reversal mechanism, the check is conveyed on a complicated conveyance path. Thus, the check is conveyed at a conveyance speed set to be low in the reversal mechanism in order to prevent an occurrence of paper clogging (referred to as "jam" below) of the check in the middle of the conveyance path. However, in recent years, there has been a demand for reducing the processing time in the printer and also for increasing the conveyance speed of a check in the reversal mechanism.

DETAILED DESCRIPTION

An aspect to be achieved by the exemplary embodiment is to provide a paper conveyance device and a printer that are capable of reducing a processing time while preventing jamming.

In general, according to one embodiment, a paper conveyance device includes a conveyance unit configured to convey long cut paper in a longitudinal direction, a measuring unit configured to measure a length of the cut paper in the longitudinal direction, which is conveyed by the conveyance unit, a reversal mechanism that reverses a front surface and a back surface to each other with conveying the cut paper, and a reversal unit configured to convey the cut paper in the reversal mechanism. The reversal unit conveys the cut paper at a first speed when the measuring unit measures that the length of the cut paper is less than a predetermined length, and conveys the cut paper at a second speed slower than the first speed when the measuring unit measures that the length of the cut paper is equal to or more than the predetermined length. In another embodiment, a paper conveyance method involves conveying long cut paper in a longitudinal direction; measuring a length of the long cut paper in the longitudinal direction, which is conveyed; reversing a front surface and a back surface to each other with conveying the long cut paper; and conveying the long cut paper in a reversal direction, wherein conveying the long cut paper at a first speed when the measured length of the long cut paper is less than a predetermined length, and conveying the long cut paper at a second speed slower than the first speed when the measured length of the long cut paper is equal to or greater than the predetermined length.

Figure 1:
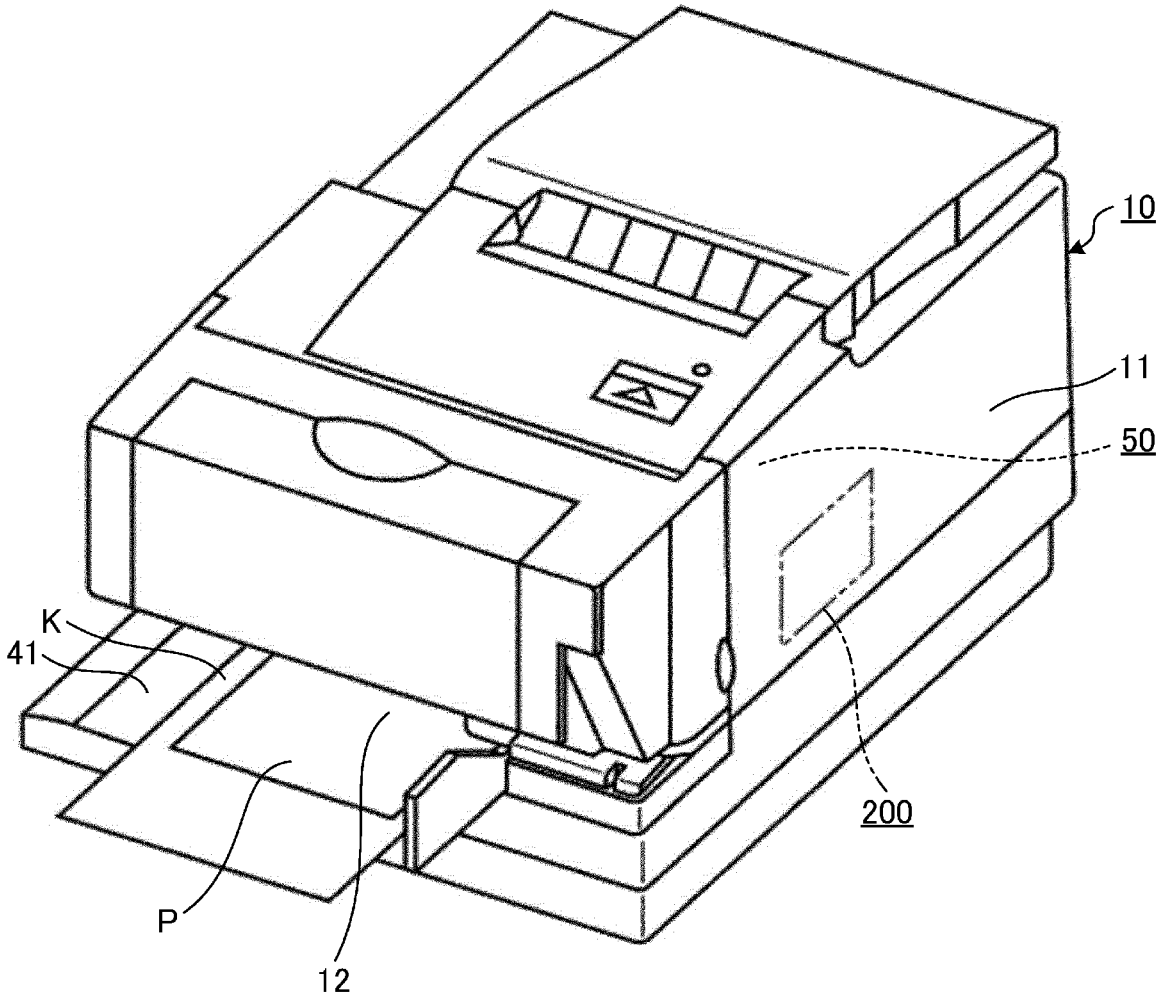
FIG. 1 is an external perspective view illustrating a printer incorporated with a paper conveyance device according to an embodiment.
Figure 2:
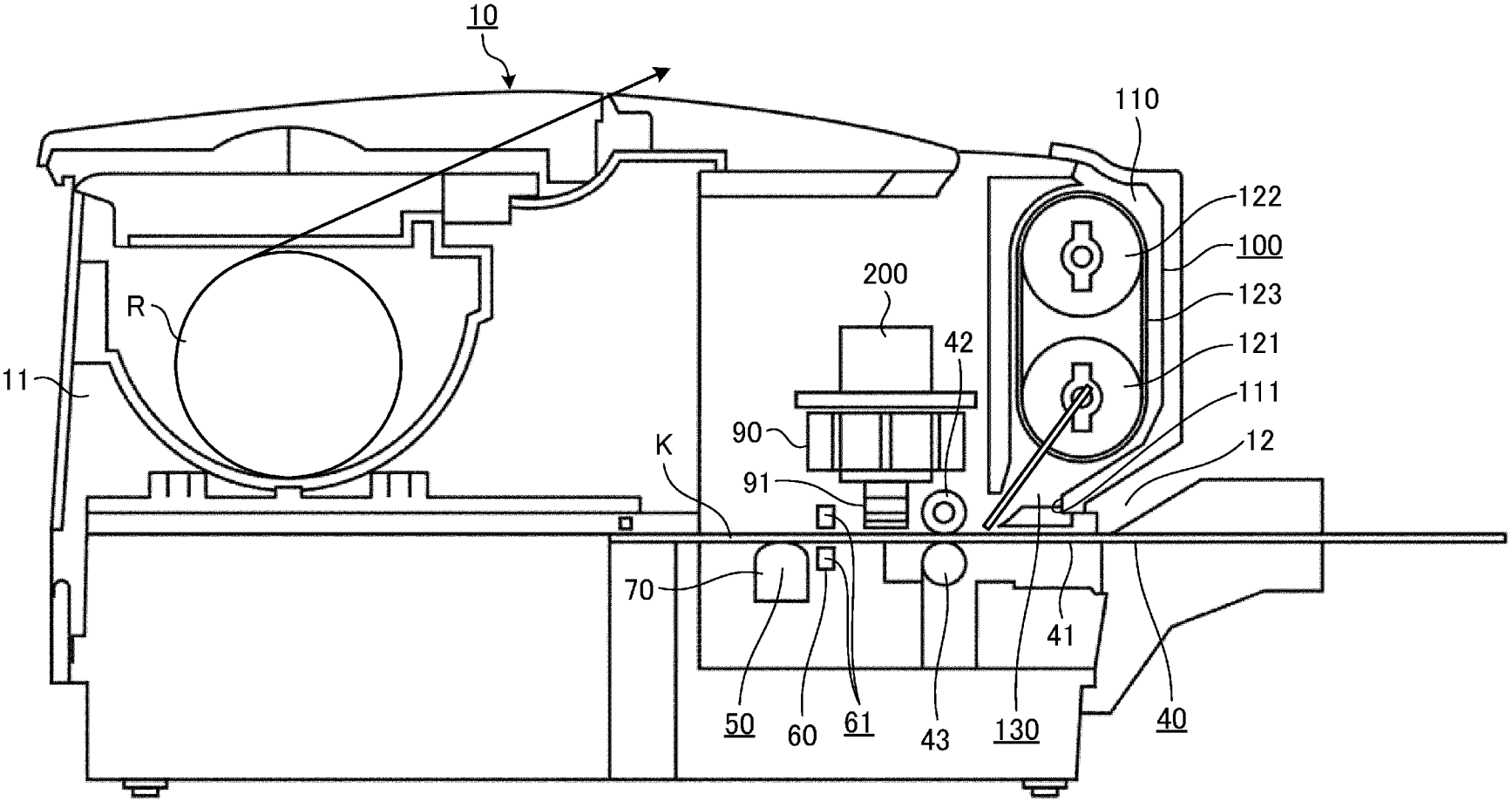
FIG. 2 is a longitudinal sectional view illustrating an overall configuration of a printer.
Figure 3:
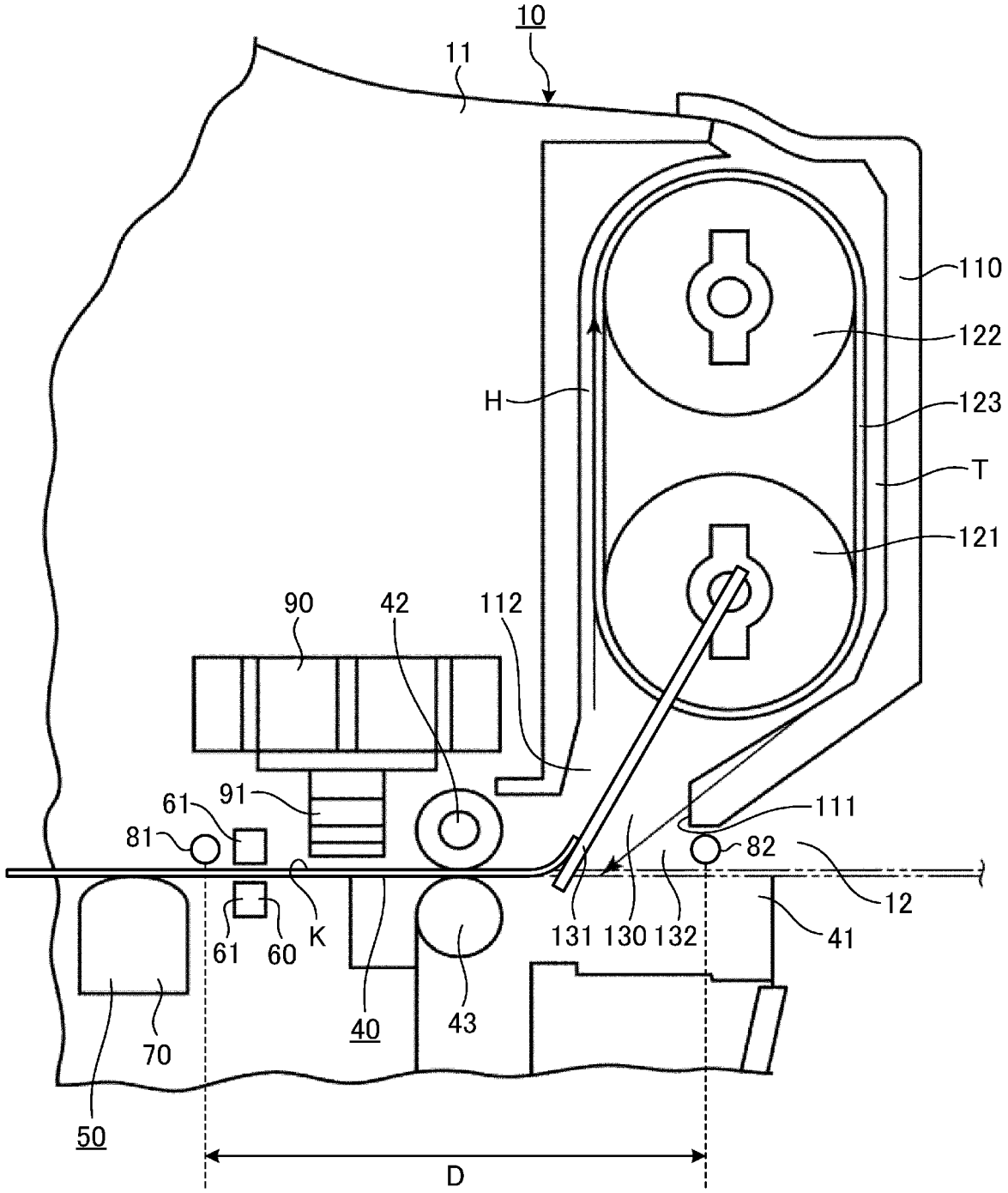
FIG. 3 is a longitudinal sectional view illustrating the paper conveyance device.

Hereinafter, embodiments will be described with reference to the drawings. FIG. 1 is an external perspective view illustrating a printer 10 in which a paper conveyance device 40 according to an embodiment is incorporated. FIG. 2 is a longitudinal sectional view illustrating an overall configuration of the printer 10. FIG. 3 is a longitudinal sectional view illustrating the paper conveyance device 40 incorporated in the printer 10.

The printer 10 is incorporated in or connected to, for example, an ATM installed in a bank or a point-of-sales (POS) terminal installed in a store, a warehouse, or the like. In FIGS. 1 to 3, P indicates a check (which has a sheet shape and is an example of cut paper), and K indicates a conveyance path of the check P. The check P is configured by a long cut sheet having a lengthwise direction. Characters or figures or graphics are printed on the check P with general ink, or MICR characters are printed on the check P with magnetic ink.

As illustrated in FIGS. 2 and 3, the printer 10 includes a housing 11. The printer 10 includes the paper conveyance device 40, a magnetic ink reading device 50, and a printing mechanism 90 in the housing 11. The printer 10 stores a receipt paper R wound in a roll shape. The receipt paper R is configured by thermal paper that is discolored by applying heat to the paper to form a character or a figure. Merchandise information or payment information relating to the purchased merchandise is printed on the receipt paper R, and the receipt paper R is dispensed from the printer 10.

The paper conveyance device 40 includes a table 41 on which a sheet-like check P is conveyed in a left-right direction in FIG. 2. A direction along the upper surface of the table 41 is set as the conveyance path K. The paper conveyance device 40 includes a plurality of rollers including a feed roller 42 and a pinch roller 43, and the like along the table 41. A medium entrance and exit 12 for inserting and discharging the check P from the outside of the printer is provided at one end portion (right end in FIG. 2) of the conveyance path K. The check P on which printing is performed in advance with magnetic ink is inserted from the medium entrance and exit 12 into the printer 10, in a state where the front surface of the check P is directed downward in FIG. 2.

The paper conveyance device 40 includes a top-of-form (TOF) sensor 81 (see FIG. 3) at a position facing the conveyance path K in the vicinity of an MICR head 70. The TOF sensor detects a leading portion of the check P carried along the conveyance path K. The TOF sensor 81 also detects whether or not there is the check P at a position (predetermined position) at which the TOF sensor 81 is installed.

The paper conveyance device 40 includes a bottom-of-form (BOF) sensor 82 (see FIG. 3) at a position facing the conveyance path K in the vicinity of the medium entrance and exit 12. The BOF sensor detects the leading portion or a tail portion of the check P. The BOF sensor 82 also detects whether or not there is the check P at a position (predetermined position) at which the BOF sensor 82 is installed.

The magnetic ink reading device 50 includes a magnetizing mechanism 60, the MICR head (magnetic head) 70, and the like in addition to the paper conveyance device 40. The magnetizing mechanism 60 magnetizes the magnetic ink of the check P on the conveyance path K. The MICR head 60 is disposed in the vicinity of a downstream side in a conveyance direction in the conveyance path K of the magnetizing mechanism 60.

The magnetizing mechanism 60 is installed close to the TOF sensor 81. The magnetizing mechanism 60 includes a magnet 61 that magnetizes an MICR character printed on the front surface of the check P conveyed along the conveyance path K. A magnetic pattern representing the MICR character is printed on the check P with magnetic ink in advance. However, a magnetic force may be weak, and thus the magnetic force of the magnetic pattern is amplified by re-magnetization of the magnetizing mechanism 60.

The MICR head 70 detects the residual magnetic force of the MICR character. The MICR character is read as a magnetic characteristic or a magnetic pattern, and is output to a control unit 200 (see FIG. 5) as an electric signal. The magnetic characteristic or the magnetic pattern of the MICR character is registered in the control unit 200 (see FIG. 5) in advance, and thus the MICR character is identified by collating the read magnetic characteristic or magnetic pattern with the registered magnetic characteristic or magnetic pattern. The MICR head 70 reads the magnetic characteristic or the magnetic pattern specific to the MICR character by sliding the residual magnetic force of the character from the right side to the left side. The read magnetic pattern is collated with a magnetic pattern stored in a pattern table 242 described later, and thereby one character having a magnetic pattern which coincides with the stored magnetic pattern is specified.

The printing mechanism 90 includes an inkjet head 91 that performs predetermined printing of which an instruction is received from the control unit 200. The inkjet head 91 forms a character or a figure by discharging particulate ink of one color or a plurality of colors onto the check P. The printing mechanism 90 is provided closer to the medium entrance and exit 12 side than the MICR head 70.

The paper conveyance device 40 includes a reversal mechanism 100. The reversal mechanism 100 conveys the check P and reverses the front surface and the back surface of the check to each other. The reversal mechanism 100 is disposed at a position facing the conveyance path K between the printing mechanism 90 and the medium entrance and exit 12. As illustrated in FIG. 3, the reversal mechanism 100 includes a rectangular parallelepiped housing 110. A reversal forward path H located on the left side in FIG. 3 and a reversal backward path T located on the right side in FIG. 3 are provided in the housing 110. An opening portion 111 is formed at the lower portion of the housing 110 and is disposed to face the conveyance path K. A reversal inlet 112 for an introduction to the reversal forward path H is provided on the MICR head 70 side of the opening portion 111.

A pair of rollers 121 and 122 are provided in the housing 110. An endless belt 123 is stretched around the pair of rollers 121 and 122. The roller 121 is driven by a reversing motor 33 (see FIG. 5). The path (reversal forward path H and reversal backward path T) on which the check P is enabled to pass is formed between the front surface of the endless belt 123 and the inner wall of the housing 110.

A switching flapper 131 is disposed at the opening portion 111 of the housing 110. The switching flapper 131 reciprocates between a position intersecting the conveyance path K and a position retracted upward from the conveyance path K, by an operation of a switching solenoid 32 (see FIG. 5). When the switching flapper 131 is located at the position intersecting the conveyance path K, the check P on which printing is performed by the inkjet head 91 is conveyed to the reversal mechanism 100. When the switching flapper 131 is located at the position retracted upward from the conveyance path K, the check P on which printing is performed by the inkjet head 91 is conveyed to the medium entrance and exit 12 along the conveyance path K.

Figure 4:
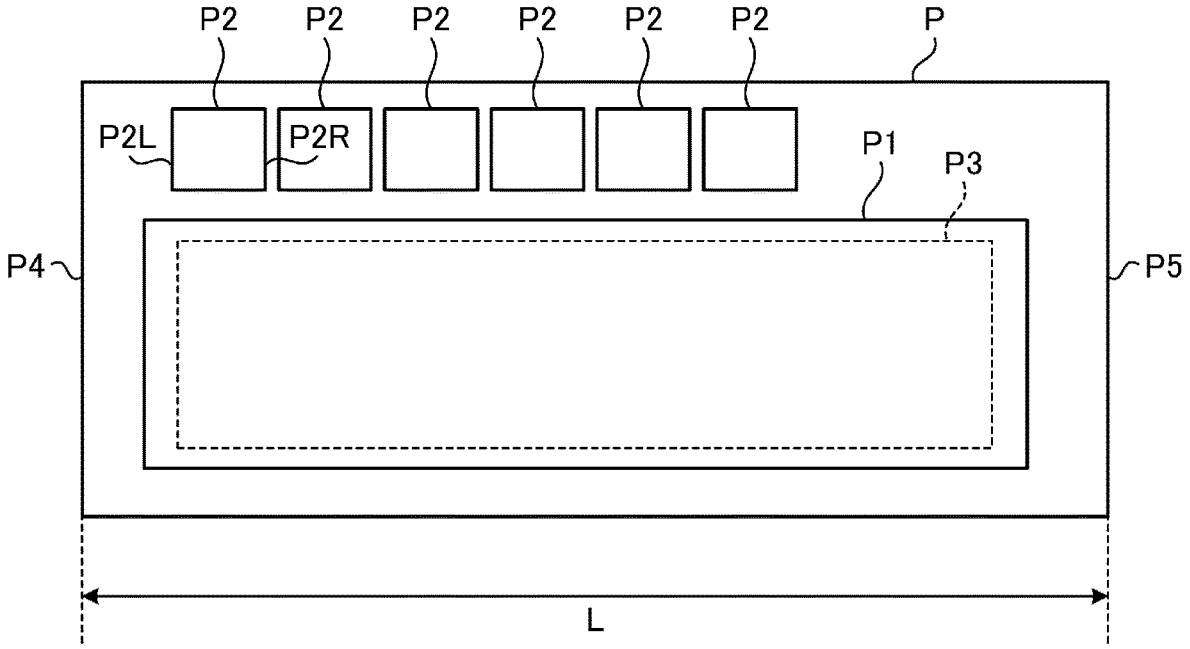
FIG. 4 is a diagram illustrating a check on which MICR characters are printed.

Here, the check P will be described. As illustrated in FIG. 4, the check P is a long sheet. The length of the check in the lengthwise direction is set as L. The check P has a front surface and a back surface. The front surface has a printing region P1. The name of the owner of the check P, the date of dispensing the check P, the par value, and the like are printed in the printing region P1 by the inkjet head 91. A signature field of the owner of the check P is provided in the printing region P1. A printing portion P2 for printing one or more MICR character with the magnetic ink is provided in the front surface. In FIG. 4, as an example, six MICR characters are printed at the printing portions P2.

Each printing portion P2 is magnetized in a predetermined magnetic pattern from the right end portion P2R toward the left end portion P2L. Each MICR character printed at the printing portion P2 has an individual magnetic pattern. Thus, it is possible to read an MICR character printed at the printing portion P2 as an individual character, by the MICR head 70 reading the magnetic pattern.

The check P has a printing region P3 on the back surface. Cashier number information for identifying a POS terminal (not illustrated) that dispenses the check P, personnel number information for identifying a person who issues the check P, and bank information of the customer, and the like are printed in the printing region P3 by the inkjet head 91. The printing region P1 may overlap the region of the printing portion P2. Since the MICR character printed at the printing portion P2 is printed with the magnetic ink, it is possible to accurately read the MICR character even though information printed in the printing region P1 is superimposed.

Figure 5:
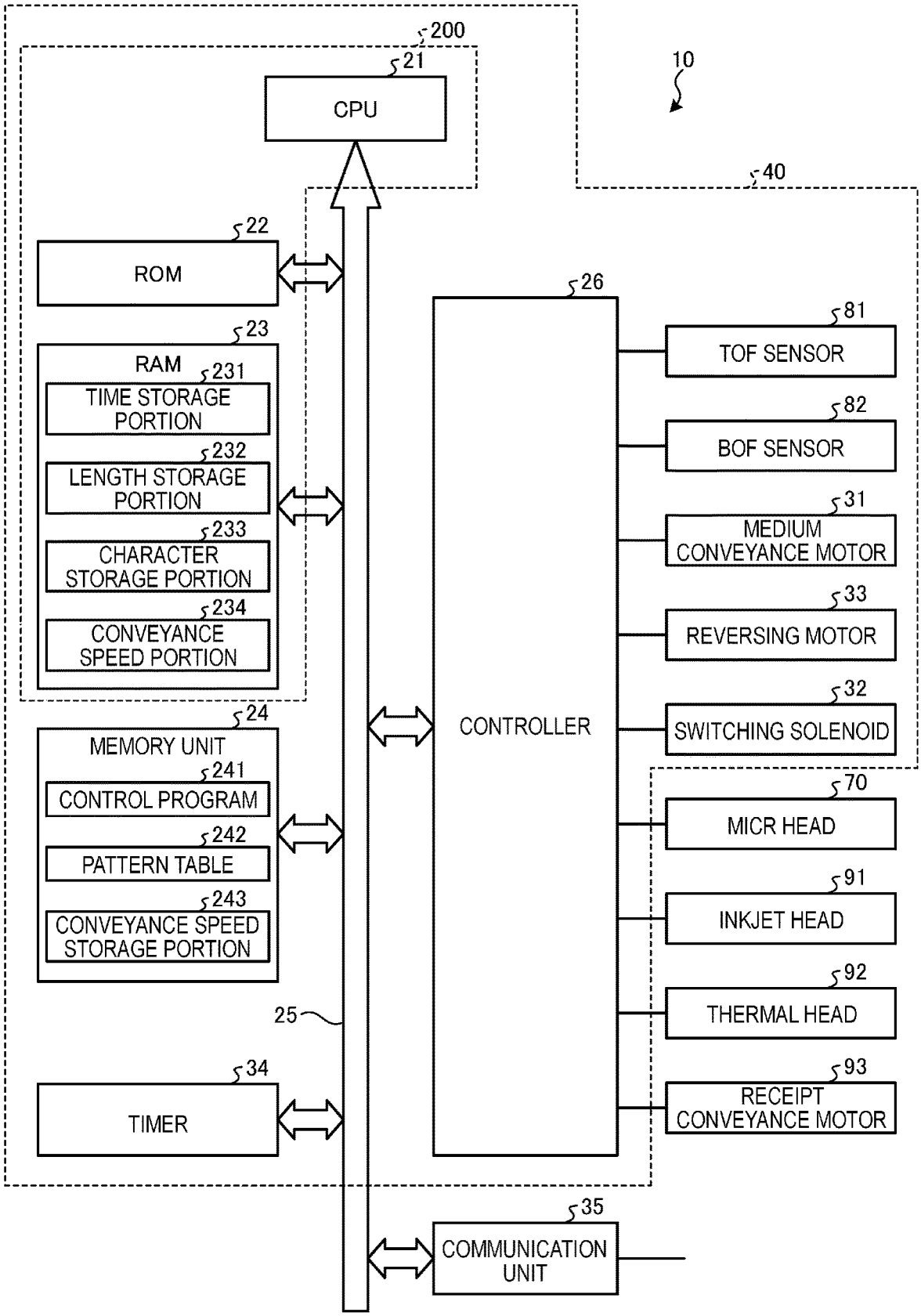
FIG. 5 is a block diagram illustrating a hardware configuration of the printer.

Here, a hardware configuration of the printer 10 will be described. FIG. 5 is a block diagram illustrating the hardware configuration of the printer 10. As illustrated in FIG. 5, the printer 10 includes a central processing unit (CPU) 21, a read only memory (ROM) 22, a random access memory (RAM) 23, a memory unit 24, and the like. The CPU 21 serves as the control subject. The ROM 22 stores various programs. The RAM 23 expands the program or various types of data. The memory unit 24 stores various programs. The CPU 21, the ROM 22, the RAM 23, and the memory unit 24 are connected to each other via a bus 25. The CPU 21, the ROM 22, and the RAM 23 form the control unit 200. That is, the control unit 200 operates in accordance with a control program which is stored in the ROM 22 or the memory unit 24 and is expanded on the RAM 23, by the CPU 21, to perform control processing relating to the printer 10, which is described later.

The RAM 23 includes a time storage portion 231, a length storage portion 232, a character storage portion 233, and a conveyance speed portion 234. The time storage portion 231 stores a time from when the TOF sensor 81 detects the leading portion P4 (see FIG. 4) of the check P until the BOF sensor 82 detects the tail portion P5 (see FIG. 4) of the check P. The length storage portion 232 stores the length L of the check P. The length L of the check P is calculated (that is, the length L of the check P is detected) based on the speed at which the paper conveyance device 40 conveys the check P, the time stored in the time storage portion 231, and a distance D (see FIG. 3) between the TOF sensor 81 and the BOF sensor 82. The character storage portion 233 stores the MICR character read by the MICR head 70. The conveyance speed portion 234 stores the conveyance speed of the check P in the reversal mechanism 100, in accordance with the measured length of the check P.

The memory unit 24 is configured by a non-volatile memory such as a hard disc drive (HDD) or a flash memory, in which stored information is held even though the power is off. The memory unit 24 includes a control program portion 241, a pattern table 242, and a conveyance speed storage portion 243. The control program portion 241 stores the control program for controlling the printer 10. A magnetic pattern for identifying each MICR character is stored in the pattern table 242. The control unit 200 may recognize the MICR character printed in the printing portion P2 by collating the magnetic pattern read by the MICR head 70 with the magnetic pattern stored in the pattern table 242. The conveyance speed storage portion 243 stores the conveyance speed of the check P in the reversal mechanism 100 for each length L of the check P. The conveyance speed storage portion 243 will be described later with reference to FIG. 6.

The control unit 200 is connected to the TOF sensor 81, the BOF sensor 82, a medium conveyance motor 31, the switching solenoid 32, the reversing motor 33, the MICR head 70, the inkjet head 91, a thermal head 92, and a receipt conveyance motor 93 through the bus 25 and a controller 26. The TOF sensor 81 is, for example, a reflection type photo sensor, and detects the leading portion P4 of the check P at the installation position of the TOF sensor 81. The TOF sensor 81 detects whether or not there is the check P at the installation position of the TOF sensor 81. The BOF sensor 82 is, for example, a reflection type photo sensor, and detects the tail portion P5 of the check P at the installation position of the BOF sensor 82. The BOF sensor 82 detects whether or not there is the check P at the installation position of the BOF sensor 82.

The medium conveyance motor 31 rotates the feed roller 42 to move the check P inserted into the medium entrance and exit 12 along the conveyance path K. Specifically, the medium conveyance motor 31 conveys the check P inserted into the medium entrance and exit 12 to a position facing the MICR head 70, on a forward path. The medium conveyance motor 31 conveys the check P from the position facing the MICR head 70 to the medium entrance and exit 12, on a backward path. The MICR head 70 reads the MICR character printed in the printing portion P2 when the check P is conveyed on the backward path. The medium conveyance motor 31 moves the check P in order to print information or a figure in the printing region P3 of the check P with the inkjet head 91. The medium conveyance motor 31 moves the check P to the reversal inlet 112 in the reversal mechanism 100.

The switching solenoid 32 causes the switching flapper 131 to reciprocate between the position intersecting the conveyance path K and the position retracted upward from the conveyance path K. The switching solenoid 32 causes the switching flapper 131 to move to the position intersecting the conveyance path K, when the check P is moved in the reversal mechanism 100. The switching solenoid 32 causes the switching flapper 131 to move the position retracted upward from the conveyance path K, when the check P reversed in the reversal mechanism 100 is conveyed again to the conveyance path K and when the check P is moved to the medium entrance and exit 12.

The reversing motor 33 rotates the roller 121 to drive the endless belt 123, and thus the check P moving in the reversal mechanism 100 is conveyed from the reversal forward path H to the reversal backward path T and then conveyed from the opening portion 111 to the conveyance path K.

The MICR head 70 reads the MICR character printed in the printing portion P2. The inkjet head 91 performs printing of a character or a figure (information) by discharging ink onto the printing region P1 and the printing region P3. The thermal head 92 includes heating elements arranged in a line and applies heat to the conveyed receipt paper R to perform printing of information. The receipt conveyance motor 93 conveys the receipt paper R. The receipt paper R on which the information is printed is dispensed from the housing 11 to the outside of the printer.

The control unit 200 is connected to a timer 34 via the bus 25. The timer 34 clocks the time. The timer 34 tracks a time from when the TOF sensor 81 detects the leading portion P4 of the check P until the BOF sensor 82 detects the tail portion P5 of the check P.

The control unit 200 is connected to a communication unit 35 via the bus 25. The communication unit 35 is connected, for example, to a POS terminal via a communication line. The communication unit 35 receives transaction information relating to the sale of merchandise, from the POS terminal.

The transaction information is used as printing data on the check P or the receipt paper R.

In the embodiment, the configuration obtained by excluding the character storage portion 233, the pattern table 242, the MICR head 70, the inkjet head 91, the thermal head 92, the receipt conveyance motor 93, and the communication unit 35 from the printer 10 illustrated in FIG. 5 corresponds to the paper conveyance device 40.

Figures 6, 7:
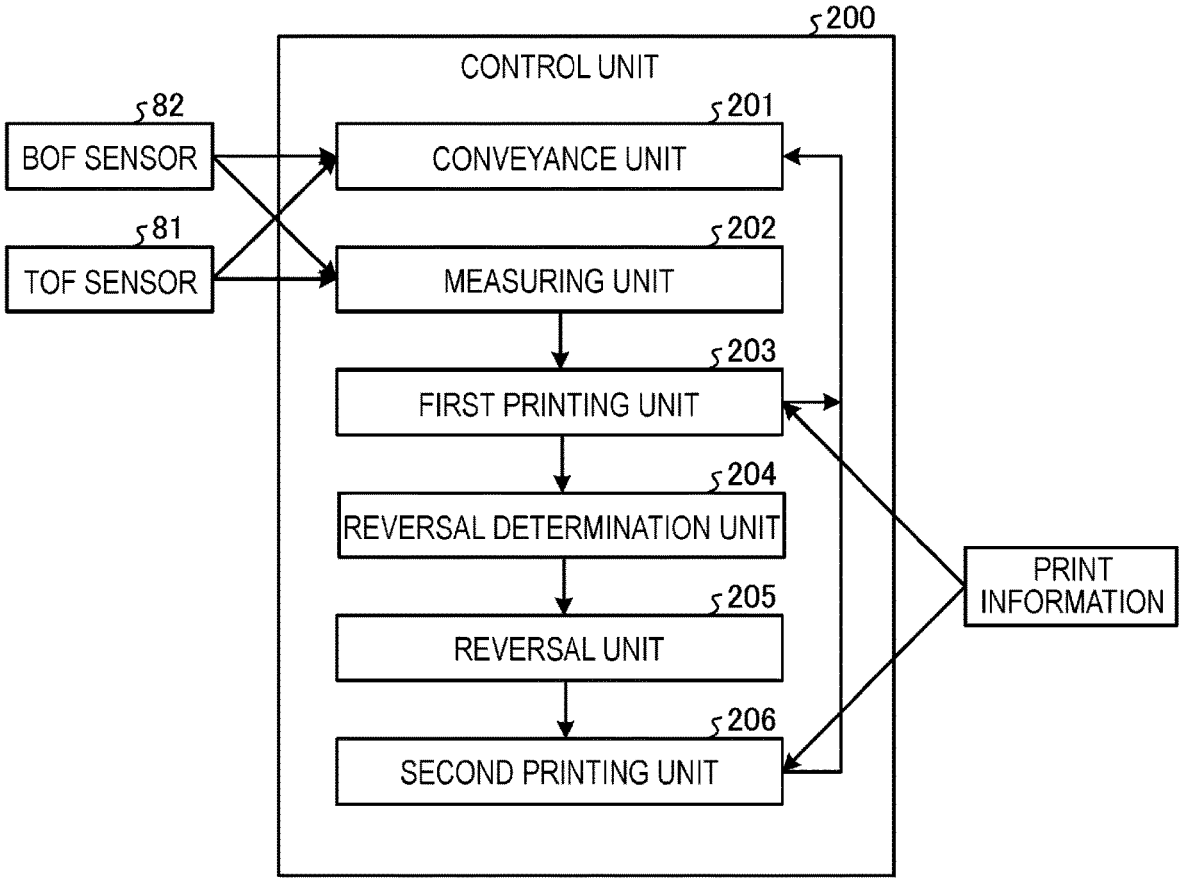
FIG. 6 is a memory map illustrating a conveyance speed storage portion.
FIG. 7 is a functional block diagram illustrating a functional configuration of the printer.

Next, the conveyance speed storage portion 243 will be described. FIG. 6 is a memory map illustrating the conveyance speed storage portion 243. The conveyance speed storage portion 243 shows a relation between the speed of the check P conveyed in the reversal mechanism 100 when the length L of the check P is less than a predetermined length and the speed of the check P conveyed in the reversal mechanism 100 when the length L of the check P is equal to or more than the predetermined length. As illustrated in FIG. 6, the conveyance speed storage portion 243 has an area 2431 and an area 2432. In the area 2431, whether the length L of the check P is less than the predetermined length, or is equal to or more than the predetermined length is stored. In the area 2432, the speed of the check p being conveyed in the reversal mechanism 100 in accordance with the length L of the check P is stored. When the length L of the check P is less than the predetermined length, a first speed is stored in the area 2432. When the length L of the check P is equal to or more than the predetermined length, a second speed is stored in the area 2432. The second speed is slower than the first speed. In the embodiment, the reference of the predetermined length is set to 200 mm, for example. In the embodiment, when the length L of the check P is less than the predetermined length, 16 IPS (distance of being conveyed is 16 inches for one second) is stored as the first speed in the area 2432. When the length L of the check P is equal to or more than the predetermined length, 6 IPS (distance of being conveyed is 6 inches for one second) is stored in the area 2432, as the second speed slower than the first speed.

It is desirable that the predetermined length (200 mm in the embodiment) is equivalent to a distance of the check P being conveyed from when the check P is introduced into the reversal inlet 112 until the check P is discharged to the opening portion 111 in the reversal mechanism 100. That is, in the case of the check P having a length L of a predetermined length, the tail portion P5 of the check P, which is introduced into the reversal inlet 112 is discharged from the opening portion 111, the leading portion P4 of the check P is being introduced into the reversal inlet 112. In other words, when the length L of the check P is longer than the predetermined length, the check P discharged from the opening portion 111 may overlap the check P introduced into the reversal inlet 112 from the opening portion.

In the printer 10 configured in such a manner, magnetic ink reading and printing are performed on the check P in a manner as follows. An operator causes the back surface of the check P to be directed upward and then inserts the check P into the medium entrance and exit 12. The control unit 200 in the printer 10 draws the check P inserted from the medium entrance and exit 12, into the printer 10. At this time, the control unit 200 measures the length L of the check P in a carrying-in direction. The printing portion P2 in the check P is magnetized. Then, the control unit 200 reads the printed MICR character while moving the drawn check P in the medium entrance and exit 12 direction. Then, the control unit 200 draws the check P again. The control unit 200 performs printing of information on the back surface side (printing region P3) of the check P. When there is no information printed on the front surface side (printing region P1), the control unit 200 causes the check P to be moved in the medium entrance and exit 12 direction and carried out. When there is information printed on the front surface side (printing region P1), the control unit 200 causes the switching flapper 131 to move to the position intersecting the conveyance path K, causes the check P to be conveyed in the reversal mechanism 100, and then causes the check P to be turned upside down. When the check P is conveyed in the reversal mechanism 100, and the length L of the check P is less than the predetermined length, the control unit 200 conveys the check P at the first speed. The control unit 200 causes the check p to be conveyed at the second speed slower than the first speed when the length L of the check P is equal to or more than the predetermined length. Then, the control unit 200 performs printing of information on the front surface side (printing region P1) of the check P and causes the check P to be moved in the medium entrance and exit 12 direction to carry out the check P.

Here, a functional configuration of the printer 10 will be described. FIG. 7 is a functional block diagram illustrating the functional configuration of the printer 10. As illustrated in FIG. 7, the control unit 200 in the printer 10 functions as a conveyance unit 201, a measuring unit 202, a first printing unit 203, a reversal determination unit 204, a reversal unit 205, and a second printing unit 206, in accordance with the control program stored in the ROM 22 or the control program portion 241 of the memory unit 24.

The conveyance unit 201 conveys a long check P (example of cut paper) in the longitudinal direction. Specifically, the conveyance unit 201 conveys the check P inserted into the medium entrance and exit 12 along the conveyance path K provided in the housing 11, with reciprocating. Specifically, when the BOF sensor 82 detects the leading portion P4 of the check P, the conveyance unit 201 drives the medium conveyance motor 31 to convey the check P inserted into the medium entrance and exit 12 along the forward path of the conveyance path K provided in the housing 11, and then convey the check P along the backward path of the conveyance path K. The conveyance unit 201 conveys the check P of which printing is performed on the back surface, to the reversal mechanism 100. The conveyance unit 201 conveys the check P turned upside down by the reversal mechanism 100, to the position of the inkjet head 91 on the forward path. The conveyance speed of the check P by the conveyance unit 201 is substantially equal to the first speed.

The measuring unit 202 measures the length L of the check P (in the longitudinal direction) conveyed by the conveyance unit 201. Specifically, the measuring unit 202 measures the length L of the check P in the conveyance direction based on an output obtained by the TOF sensor 81 detecting the leading portion P4 of the check P and an output obtained by the BOF sensor 82 detecting the tail portion P5 of the check P. More specifically, the measuring unit 202 calculates the length L of the check P in the conveyance direction (that is, measures the length L of the check P) based on a conveyance time of the check P, the distance D between the TOF sensor 81 and the BOF sensor 82, and the conveyance speed of the check P. The conveyance time of the check is based on the output obtained by the TOF sensor 81 detecting the leading portion P4 of the check P and the output obtained by the BOF sensor 82 detecting the tail portion P5 of the check P.

The first printing unit 203 performs printing on one surface side (back surface) of the check P with the printing mechanism 90. Specifically, the first printing unit 203 performs printing on the back surface of the check P with the printing mechanism 90, based on input printing data, while the check P conveyed by the conveyance unit 201 is conveyed on the backward path. The first printing unit 203 may perform printing while the check P is conveyed on the forward path by the conveyance unit 201.

The reversal determination unit 204 determines whether or not it is required to reverse the check P. Specifically, the reversal determination unit 204 determines whether or not it is required to reverse the check P, based on whether or not printing is performed by the second printing unit 206 (that is, whether or not there is printing data printed on the front surface of the check P). When printing is performed by the second printing unit 206 (that is, there is printing data printed on the front surface and the back surface of the check P), the reversal determination unit 204 determines that it is required to reverse the front surface and the back surface of the check P to each other. When printing is not performed by the second printing unit 206 (that is, there is printing data printed on the back surface of the check P, but there is no printing data printed on the front surface of the check P), the reversal determination unit 204 determines that it is not required to reverse the front surface and the back surface of the check P to each other.

The reversal unit 205 conveys the check P in the reversal mechanism 100. Specifically, the reversal unit 205 conveys the check P on which printing is performed by the first printing unit 203, in the reversal mechanism 100. The reversal mechanism 100 reverses the front surface and the back surface of the check P conveyed by the reversal unit 205, to each other.

When the length L of the check P, which is measured by the measuring unit 202, is less than the predetermined length (for example, 200 mm), the reversal unit 205 conveys the check P at the first speed (for example, 16 inches for one second (referred to as "16 IPS") below). When the length L of the check P, which is measured by the measuring unit 202, is equal to or more than the predetermined length (for example, 200 mm), the reversal unit 205 conveys the check P at the second speed (for example, 6 inches for one second (referred to as "6 IPS") below) slower than the first speed. When the length L of the check P is equal to or more than the predetermined length, the conveyance direction of the check P is rapidly changed in the reversal inlet 112 or the opening portion 111. Thus, the check P more easily causes jamming than when the length L of the check P is less than the predetermined length. Accordingly, in order to prevent the jamming, the conveyance speed of the check P is reduced by setting the conveyance speed of the check P to the second speed. In the case where the conveyance speed of the check is slow, the check P has more difficulty in causing jamming than that when the conveyance speed is fast.

When the reversal determination unit 204 determines that it is required to reverse the front surface and the back surface of the check P to each other, the reversal unit 205 conveys the check P in the reversal mechanism 100. When the reversal determination unit 204 determines that it is required to reverse the check P, based on whether or not printing is performed by the second printing unit 206, the reversal unit 205 conveys the check P in the reversal mechanism 100.

The second printing unit 206 performs printing on the other surface side (front surface) of the check P turned upside down by the reversal mechanism 100, with the printing mechanism 90. Specifically, the second printing unit 206 performs printing on the other surface side (front surface side in the embodiment) of the check P based on input printing data, while the conveyance unit 201 conveys the check P turned upside down by the reversal unit 205, on the backward path. The second printing unit 206 may perform printing while the check P turned upside down by the reversal mechanism 100 is conveyed on the forward path by the conveyance unit 201.

Figure 8:
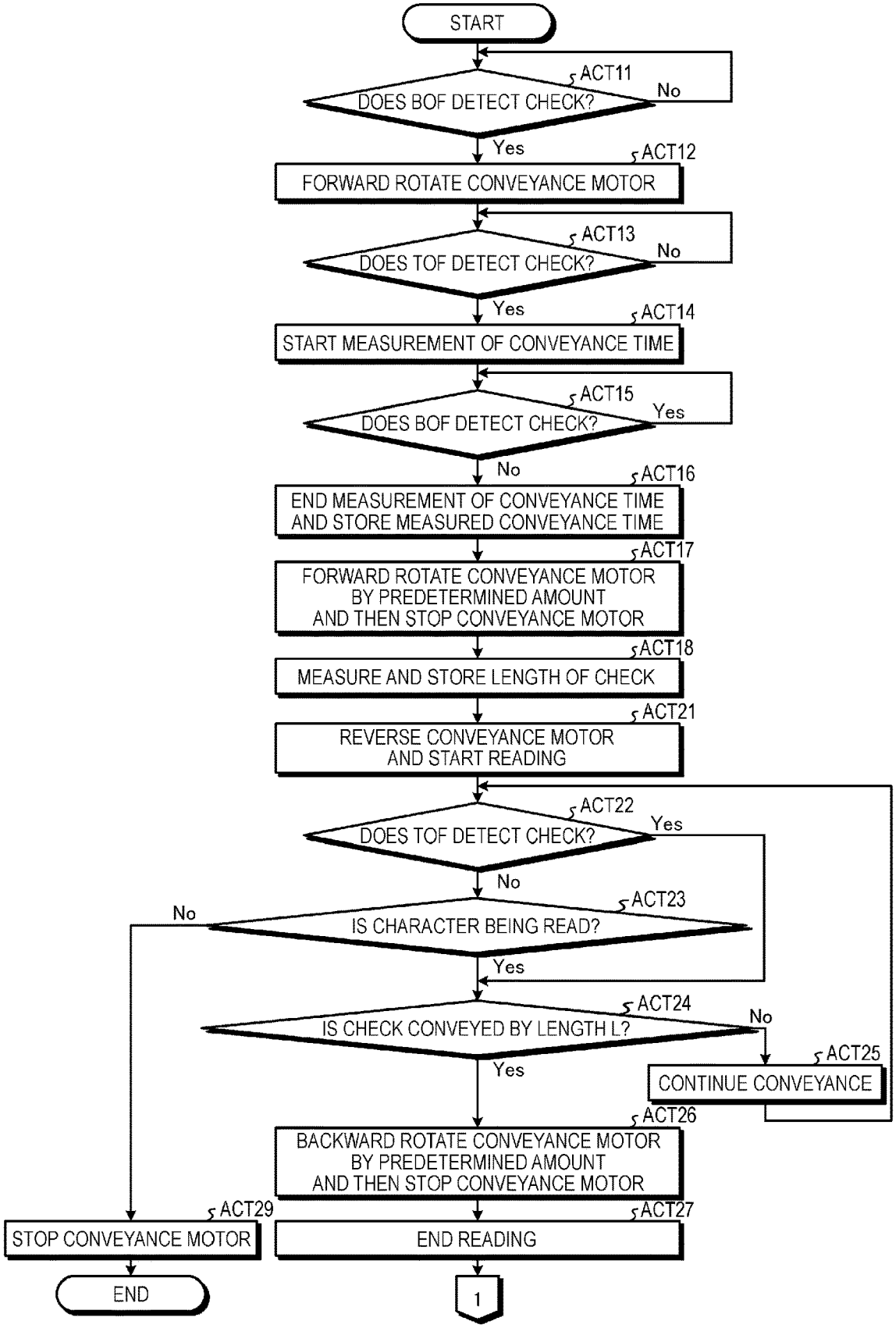
FIG. 8 is a flowchart illustrating control processing of the printer.
Figure 9:
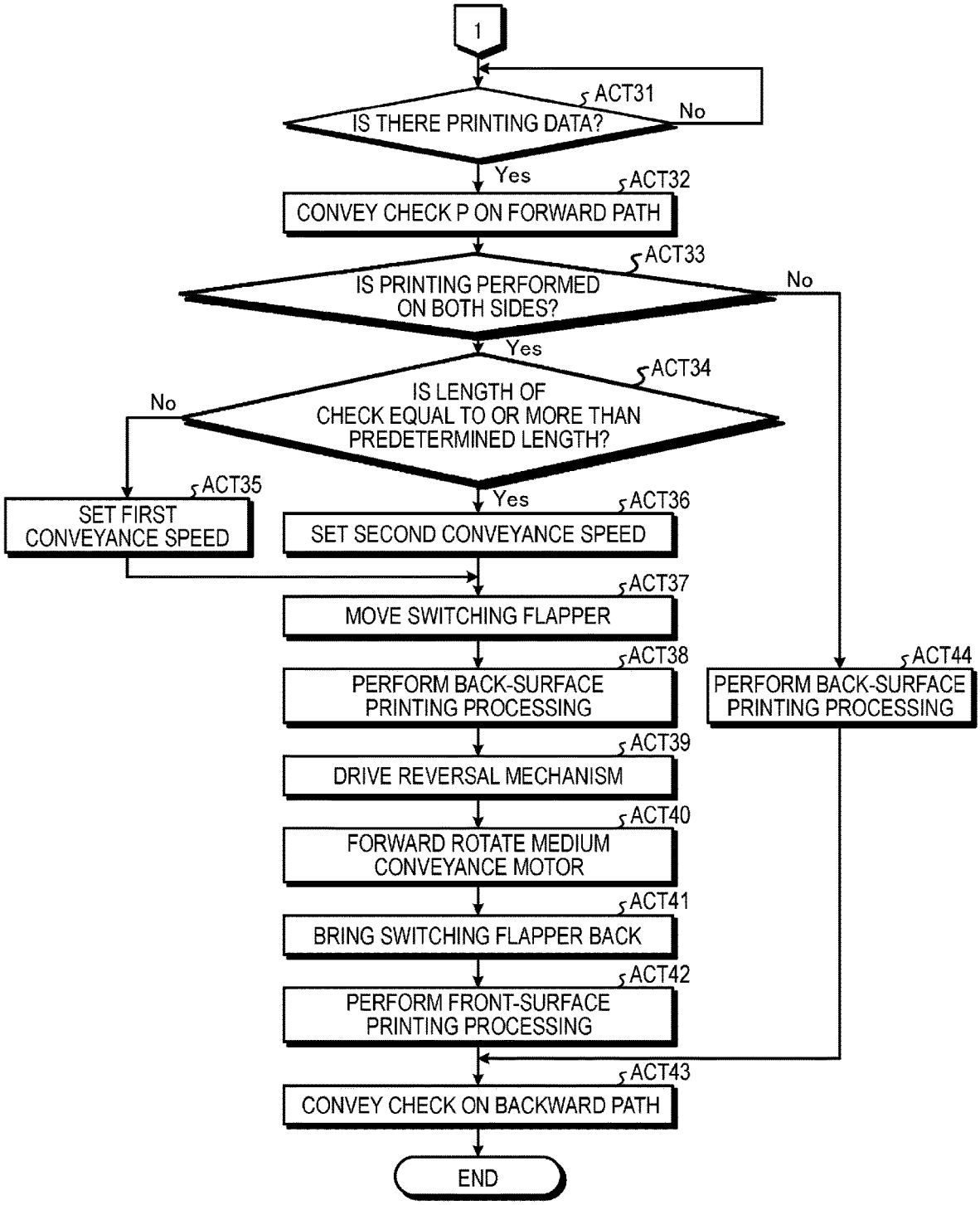
FIG. 9 is a flowchart illustrating the control processing of the printer.

Here, a control of the printer 10 will be described. FIGS. 8 and 9 are flowcharts illustrating control processing of the printer 10. As illustrated in FIGS. 8 and 9, the control unit 200 in the printer 10 determines whether the BOF sensor 82 detects the check P carried in from the medium entrance and exit 12 (ACT 11). The control unit waits until the BOF sensor 82 detects the check P (No in ACT 11). When the BOF sensor 82 detects the check P (Yes in ACT 11), the conveyance unit 201 rotates medium conveyance motor 31 forward (ACT 12). When the medium conveyance motor is forward rotated, the feed roller 42 rotates. The conveyance unit 201 carries the check P in by conveying the check P on the forward path of the conveyance path K.

Then, the control unit 200 determines whether or the TOF sensor 81 detects the leading portion P4 of the check P (ACT 13). The control unit waits until the TOF sensor 81 detects the leading portion P4 of the check P (No in ACT 13). When the control unit determines that the leading portion P4 of the check P is detected (Yes in ACT 13), the measuring unit 202 starts measuring the conveyance time of the check P (ACT 14). Specifically, the measuring unit 202 activates the timer 34 and starts measuring the conveyance time of the check P.

The control unit 200 determines whether the BOF sensor 82 detects the tail portion P5 of the check P (ACT 15). The control unit waits until the BOF sensor 82 detects the tail portion P5 of the check P (No in ACT 15). When the BOF sensor 82 detects the tail portion P5 of the check P (Yes in ACT 15), the measuring unit 202 ends the measuring of the conveyance time of the check P, which is started in ACT 14 (ACT 16). Specifically, the measuring unit 202 stops the timer 34 and ends the measuring of the conveyance time of the check P. The measuring unit 202 stores the conveyance time measured by the timer 34, in the time storage portion 231.

Then, the control unit 200 drives the medium conveyance motor 31 to convey the check P on the forward path by a predetermined distance. Then, the control unit stops the medium conveyance motor 31 (ACT 17).

The measuring unit 202 measures (calculates) the length L of the check P in the conveyance direction (ACT 18). Specifically, the measuring unit 202 measures (calculates) the length L of the check P based on a time for which the check P is conveyed between ACT 14 and ACT 17 (time stored in the time storage portion 231), that is, the time measured by the timer 34, the predetermined conveyance speed (first speed in the embodiment) of the check P, and the distance D. The measuring unit 202 stores the measured length L of the check P in the length storage portion 232 (ACT 18).

From here, processing of reading the MICR character while the check P is conveyed on the backward path is performed. That is, the conveyance unit 201 drives the medium conveyance motor 31 backward to start conveyance of the check P on the backward path (ACT 21). The control unit 200 starts reading of the MICR character by the MICR head 70 (ACT 21). When the MICR character is being read, the control unit 200 sets, for example, an in-reading flag to "1". The control unit 200 drives the medium conveyance motor 31 by the above drive amount and measures a distance of the check P being conveyed after the process of ACT 21.

The control unit 200 determines whether or the TOF sensor 81 detects the check P (ACT 22). When the control unit determines that the TOF sensor 81 does not detect the check P (No in ACT 22), the control unit 200 checks the in-reading flag to determine whether the MICR character is being read by the control unit 200 (ACT 23). When the MICR character is being read by the control unit 200 (Yes in ACT 23), the control unit 200 determines whether or not the check P is conveyed by a distance corresponding to the length L stored in the length storage portion 232, after the process of ACT 21 is started, (ACT 24). When the check P is not conveyed by the distance corresponding to the length L (No in ACT 24), the control unit 200 continues the conveyance of the check P (ACT 25). That is, the control unit 200 continues the conveyance of the check P by the conveyance unit 201 without the control unit 200 stopping the conveyance of the check P, even when the TOF sensor 81 does not detect the check P. Reading of the MICR character by the control unit 200 also continues (ACT 25). Then, the control unit 200 returns to ACT 22.

The TOF sensor 81 may detect there is no check P even though there is the check P at the installation position of the TOF sensor 81, depending on a character, a figure, a background, or the like printed on the check P. Therefore, with ACTS 22 to 24, when the TOF sensor 81 detects no check P regardless of the MICR character being read, it is determined whether the check P is conveyed by the distance corresponding to the length L of the check P from the process of ACT 21. When the check P is not conveyed by the distance corresponding to the length L of the check P, processing of continuing the conveyance of the check P is performed.

When the check P is conveyed by the distance corresponding to the length L (Yes in ACT 24), the control unit 200 drives the medium conveyance motor 31 to convey the check P on the backward path by a predetermined distance. Then, the control unit stops the driving (ACT 26). The control unit 200 ends the reading of the MICR character by the MICR head 70 (ACT 27). In ACT 27, the control unit 200 stores the read MICR character in the character storage portion 233.

When the control unit 200 determines that the TOF sensor 81 detects the check P (Yes in ACT 22) in ACT 22, the control unit performs the determination of ACT 24 without the determination of ACT 23. When the control unit determines that the MICR character is not being read by the MICR head 70 (No in ACT 23) in ACT 23, the control unit 200 stops the conveyance of the check P by the conveyance unit 201 (ACT 29).

When the TOF sensor 81 does not detect the check P in the middle of printing on the check P, the control unit 200 stops the conveyance of the check P by the conveyance unit 201 (ACT 29). The control unit 200 performs the process of ACT 29, and then ends the processing.

Here, description will be made with reference to FIG. 9. After the process of ACT 27 is performed, the control unit 200 determines whether to receive printing data from an external device (for example, POS terminal) connected to the printer 10 (ACT 31). The control unit waits until receiving the printing data (No in ACT 31). When the control unit determines to receive the printing data (Yes in ACT 31), the conveyance unit 201 rotates the medium conveyance motor 31 forward to draw the check P and to convey the check P to the printing position by the inkjet head 91 on the forward path (ACT 32).

Figure 10:
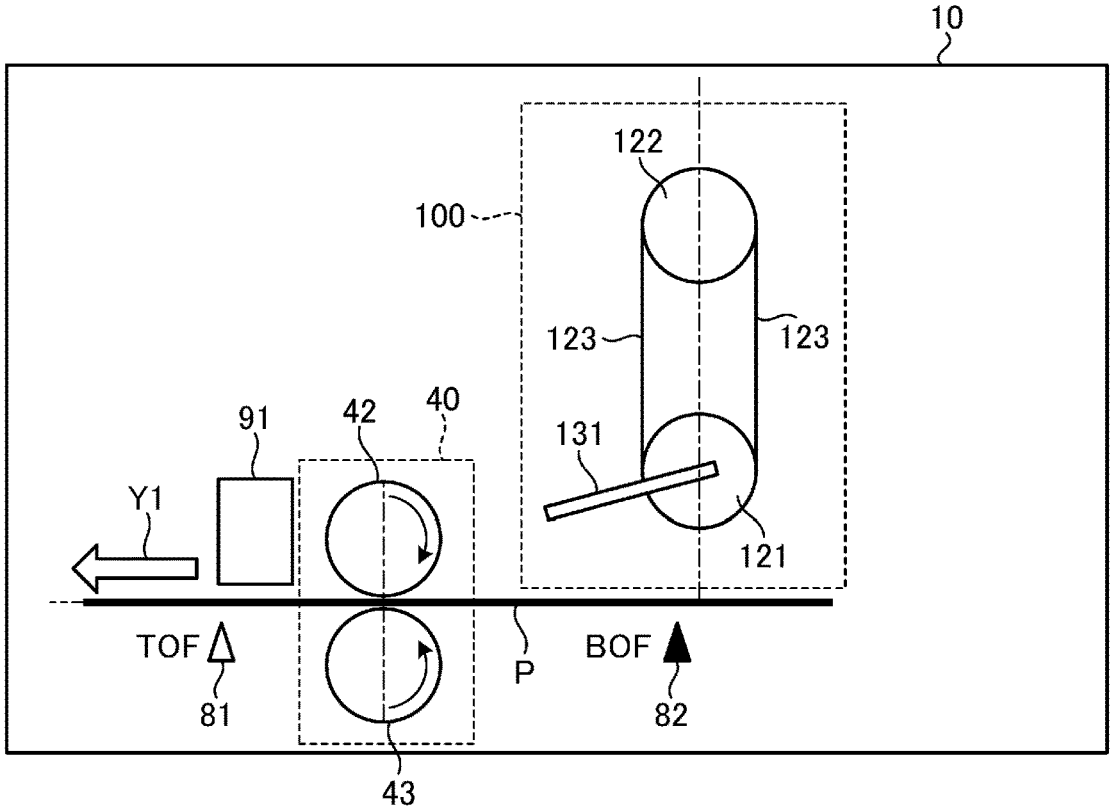
FIG. 10 is a diagram illustrating a state where the check is inserted into the printer.

FIG. 10 is a diagram illustrating that the conveyance unit 201 draws the check P and then conveys the check P on the forward path. As illustrated in FIG. 10, the conveyance unit 201 rotates the feed roller 42 and the pinch roller 43 to convey the check P to the position facing the inkjet head 91 on the forward path in a direction indicated by an arrow Y1. At this time, the switching flapper 131 is located at the position retracted upward from the conveyance path K, and thus does not hinder the conveyance of the check P.

Then, the reversal determination unit 204 determines whether printing is performed on both sides of the check P (that is, whether printing is also performed on the front surface of the check P), based on the printing data received in ACT 31 (ACT 33). When it is determined that double-sided printing is performed (Yes in ACT 33), the control unit 200 determines whether the length L of the check P, which is measured and stored in the length storage portion 232 in ACT 18 is equal to or more than the predetermined length (ACT 34). When the control unit determines that the length L of the check P is less than the predetermined length (No in ACT 34), the control unit 200 reads the first speed corresponding to a case of being less than the predetermined length, from the area 2432, and sets the first speed in the conveyance speed portion 234 (ACT 35). When the control unit determines that the length L of the check P is equal to or more than the predetermined length (Yes in ACT 34), the control unit 200 reads the second speed corresponding to a case of being equal to or more than the predetermined length, from the area 2432, and sets the second speed in the conveyance speed portion 234 (ACT 36).

Then, the reversal unit 205 drives the switching solenoid to move the switching flapper 131 to the position intersecting the conveyance path K (ACT 37).

Figure 11:
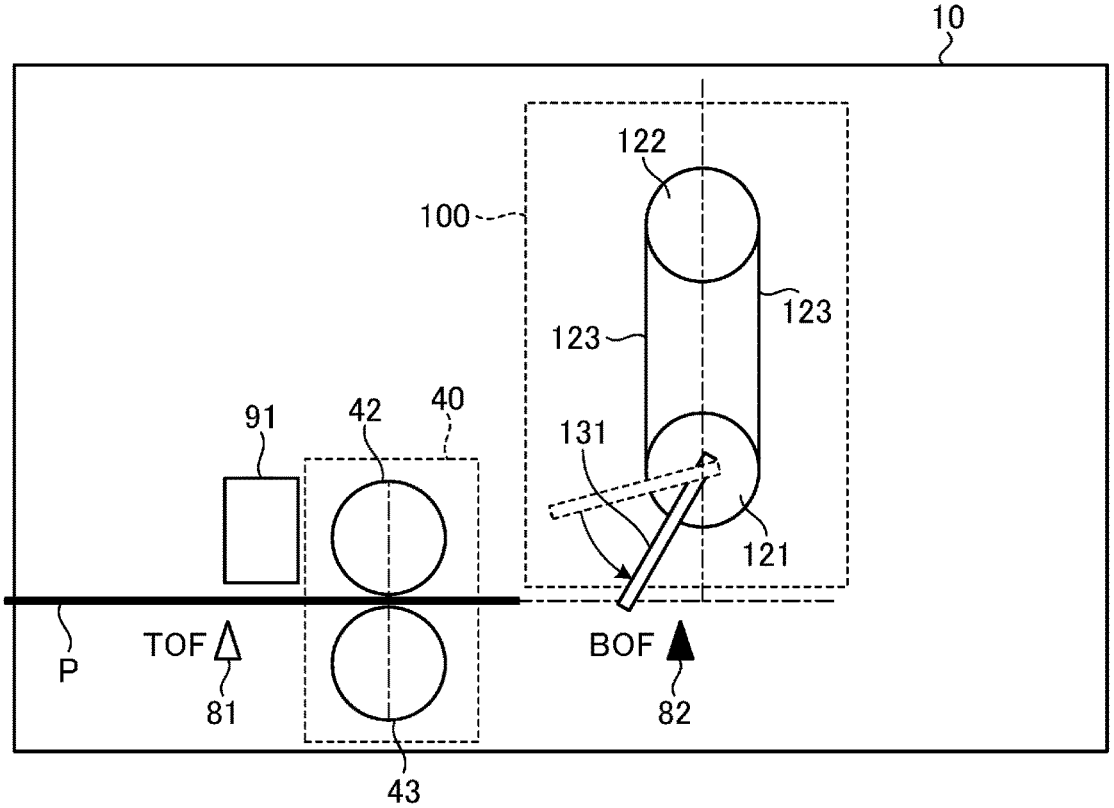
FIG. 11 is a diagram illustrating a state where the check is located at a printing position in the printer such that a back surface of the check is directed upward.

FIG. 11 is a diagram illustrating a state where the switching flapper 131 is moved to the position intersecting the conveyance path K in ACT 37. In FIG. 11, the reversal unit 205 drives the switching solenoid 32 to move the switching flapper 131 from the position retracted upward from the conveyance path K to the position intersecting the conveyance path K. In this state, the tail portion P5 of the check P conveyed on the backward path abuts on the switching flapper 131 and then is introduced into the reversal inlet 112.

The first printing unit 203 performs printing on the back surface of the check P conveyed on the backward path, in accordance with printing data (ACT 38). Then, the reversal unit 205 drives the reversing motor 33 to rotate the endless belt 123. The reversal unit 205 conveys the check P introduced into the reversal inlet 112 to the reversal forward path H in the reversal mechanism 100 (ACT 39). At this time, the reversal unit 205 conveys the check P at the speed stored in the conveyance speed portion 234. That is, when the first speed is stored in the conveyance speed portion 234, the reversal unit 205 conveys the check P at the first speed. When the second speed is stored in the conveyance speed portion 234, the reversal unit 205 conveys the check P at the second speed.

Figure 12:
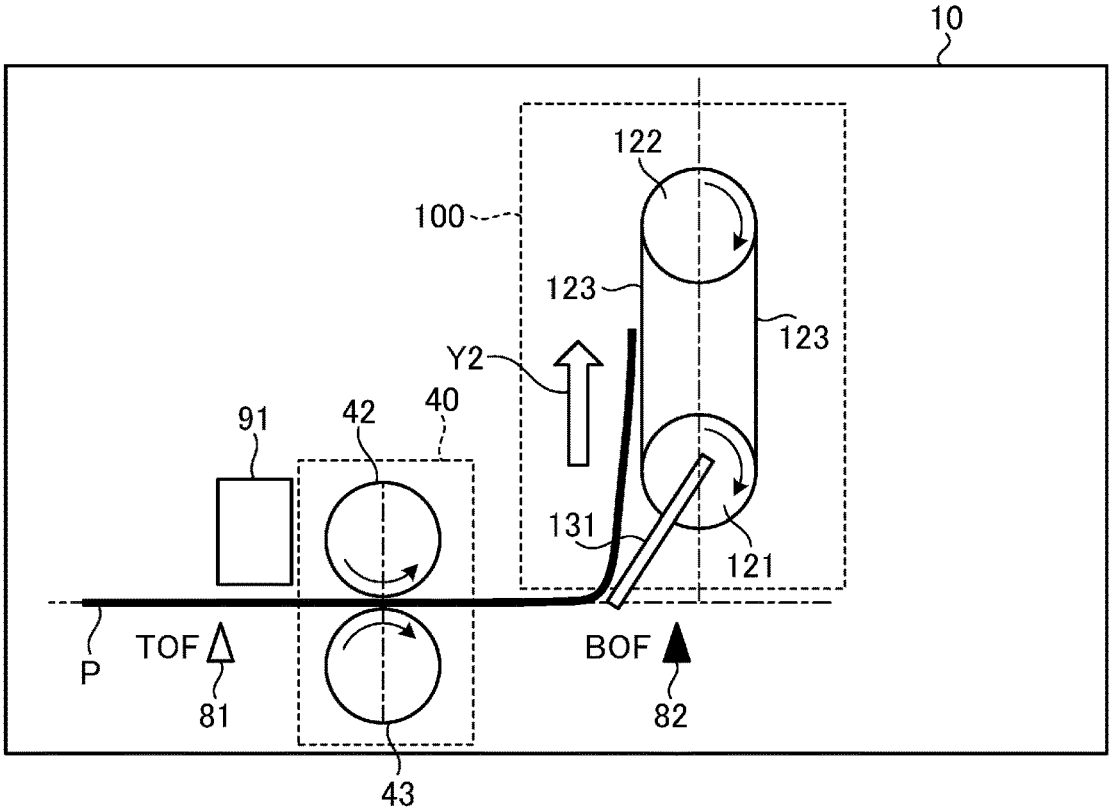
FIG. 12 is a diagram illustrating a state where the check is being taken into the reversal mechanism.
Figure 13:
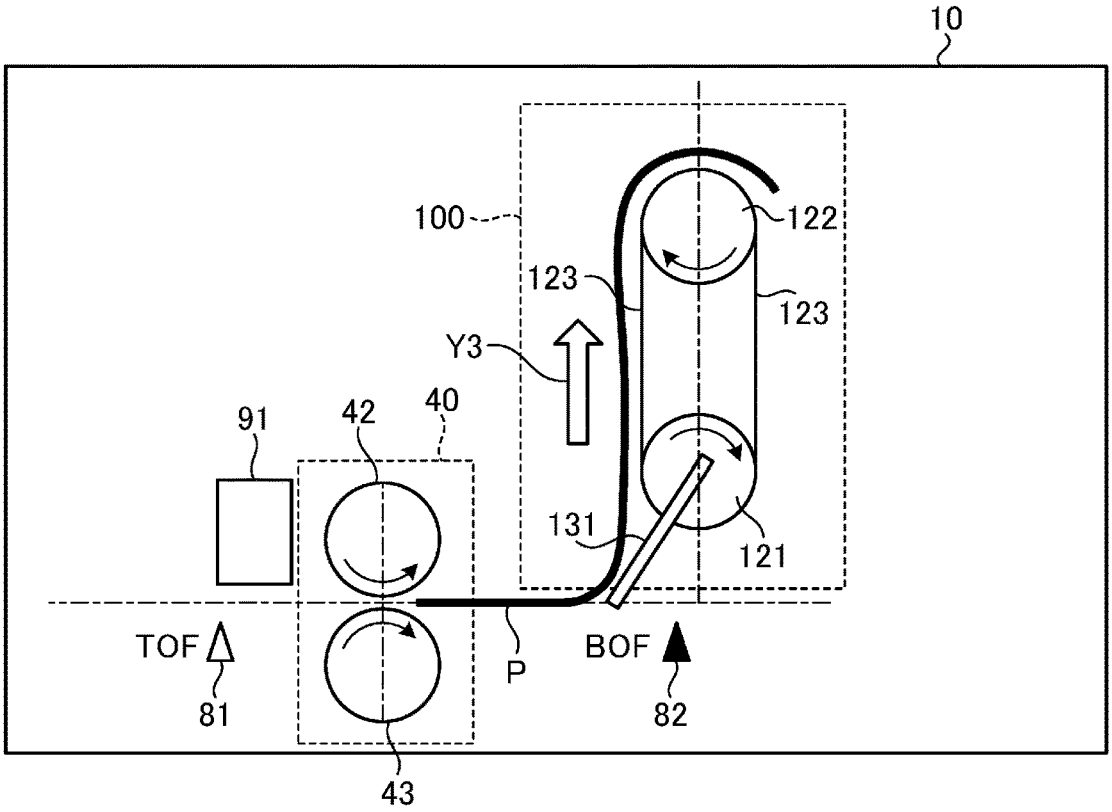
FIG. 13 is a diagram illustrating a state where the check is further taken into the reversal mechanism.

FIG. 12 is a diagram illustrating the check P conveyed to the reversal forward path H in ACT 39. In FIG. 12, the endless belt 123 rotates, and thereby the tail portion P5 of the check P is conveyed upward on the reversal forward path H in a direction indicated by an arrow Y2. FIG. 13 is a diagram illustrating a state where the check P conveyed to the reversal forward path H is directed toward the reversal backward path T. In FIG. 13, the endless belt 123 rotates, and thereby the check P rises on the reversal forward path H in a direction indicated by an arrow Y3. Then, the direction is reversed, and thus the check P is conveyed toward the reversal backward path T.

Then, the reversal unit 205 conveys the check P toward the reversal backward path T. The conveyance unit 201 rotates the medium conveyance motor 31 forward and rotates the feed roller 42 and the pinch roller 43 to convey the check P on the forward path (ACT 40).

Figure 14:
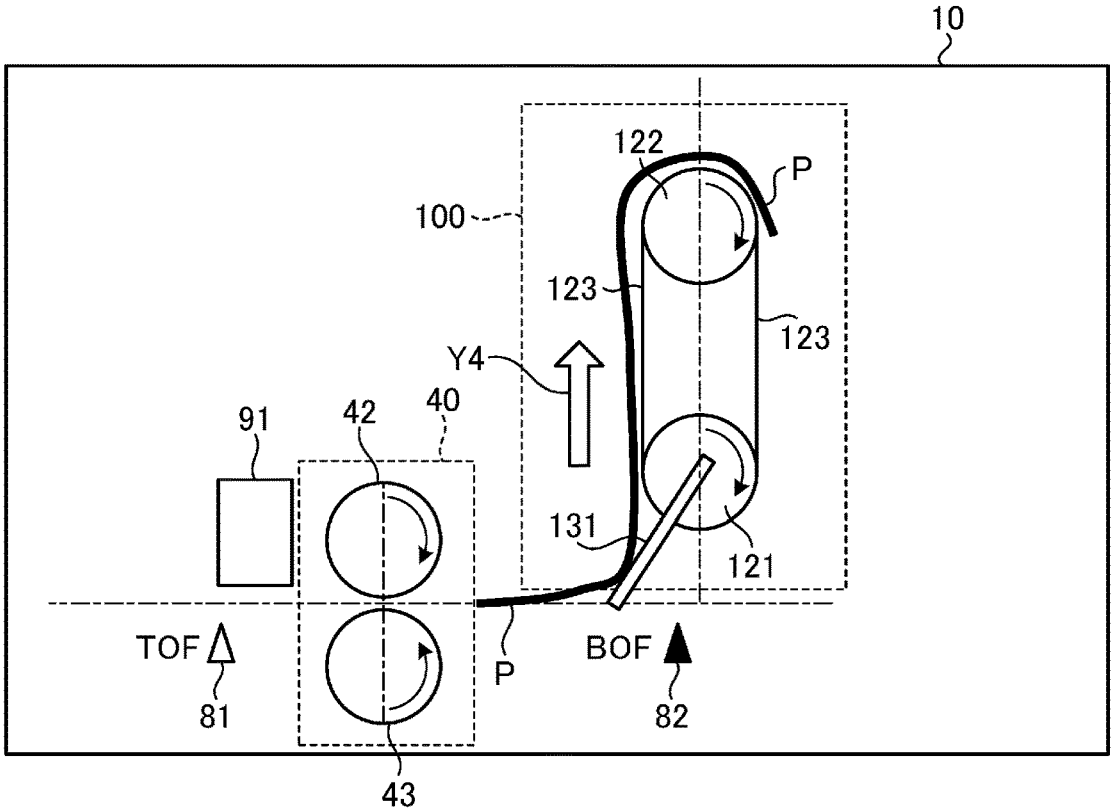
FIG. 14 is a diagram illustrating a state where the check is almost taken into the reversal mechanism.

FIG. 14 is a diagram illustrating a state where the check P is conveyed toward the reversal backward path T in ACT 40. In FIG. 14, the check P is conveyed in a direction indicated by an arrow Y4. The leading portion P4 is nipped by the feed roller 42 and the pinch roller 43 and then is released, and thus becomes free. In FIG. 14, the feed roller 42 and the pinch roller 43 rotate in a direction in which the check P is conveyed on the forward path.

Then, the reversal unit 205 drives the switching solenoid 32 to move the switching flapper 131 from the position intersecting the conveyance path K to the position retracted upward from the conveyance path K (ACT 41). Since the switching flapper 131 is moved to the position retracted upward from the conveyance path K, the check P conveyed on the reversal backward path T is conveyed again on the conveyance path K in a direction of the forward path. The front surface and the back surface of the check P are reversed to each other by conveying the check P from the reversal forward path H to the reversal backward path T in the reversal mechanism 100, and then the check P is conveyed to the printing position on the conveyance path K.

Figure 15:
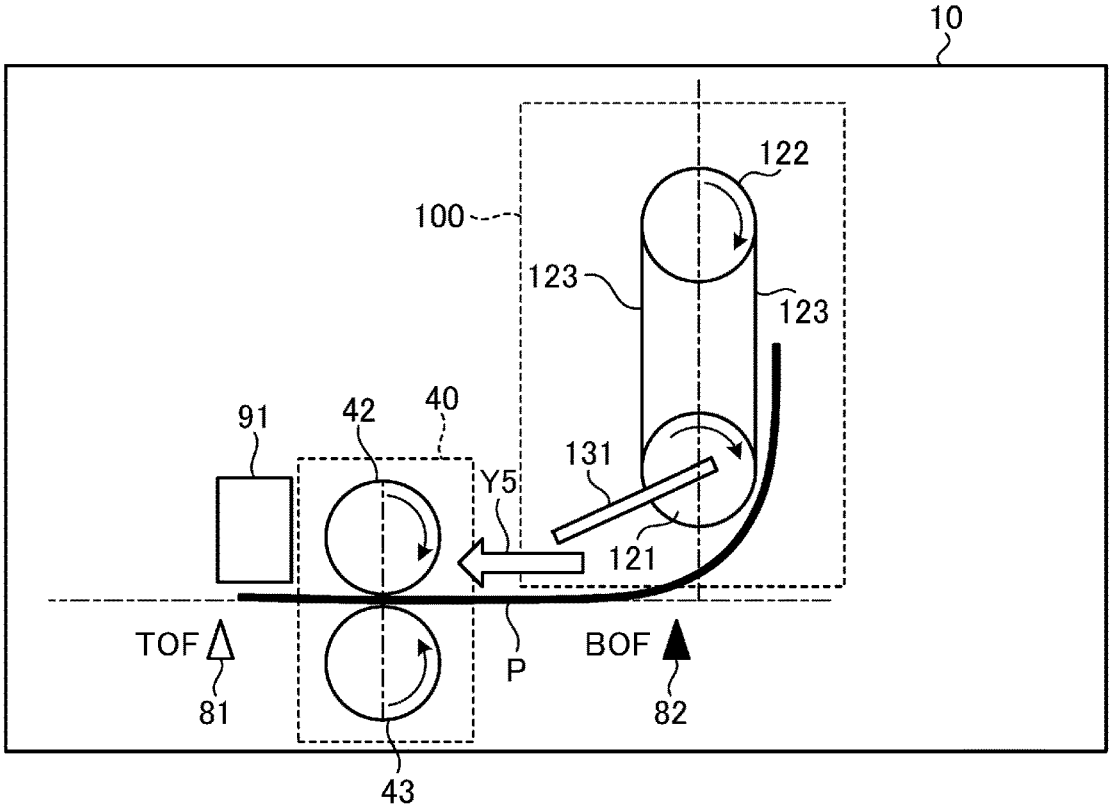
FIG. 15 is a diagram illustrating a state where the check taken into the reversal mechanism is turned upside down, and then is discharged from the reversal mechanism.
Figure 16:
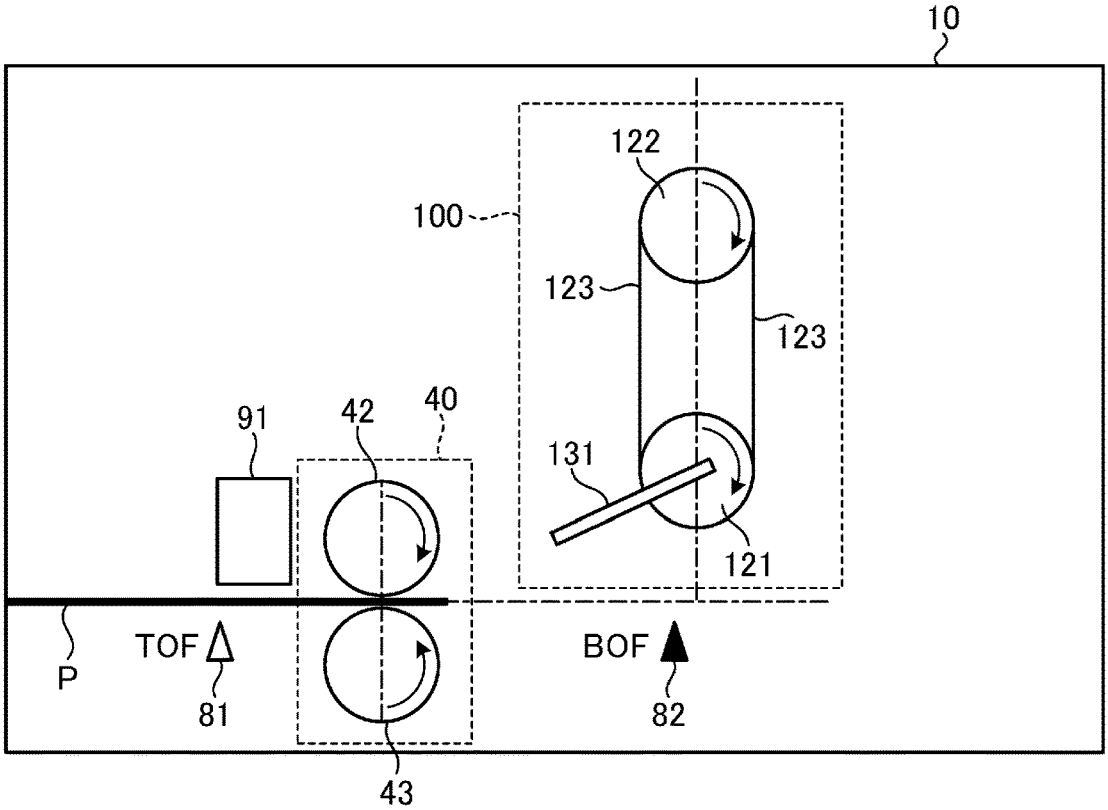
FIG. 16 is a diagram illustrating a state where the check turned upside down is located at a printing position in the printer.

FIG. 15 is a diagram illustrating a state where the check P turned upside down is conveyed again on the conveyance path K in the direction of the forward path in ACT 40. In FIG. 15, the conveyance unit 201 rotates the feed roller 42 and the pinch roller 43 to nip the check P conveyed from the reversal backward path T on the conveyance path K, and then to convey the check P in a direction of the inkjet head 91 on the forward path (direction indicated by an arrow Y5).

Then, the second printing unit 206 drives the inkjet head 91 to perform printing on the front surface based on printing data received in ACT 31, while the check P arrived at the printing position is conveyed on the backward path (ACT 42). The conveyance unit 201 conveys the check P of which printing is performed on the front surface side, on the forward path. Then, the conveyance unit discharges the check P from the medium entrance and exit 12 to the outside of the housing 11 (ACT 43). Then, the control unit 200 ends the processing.

Figure 17:
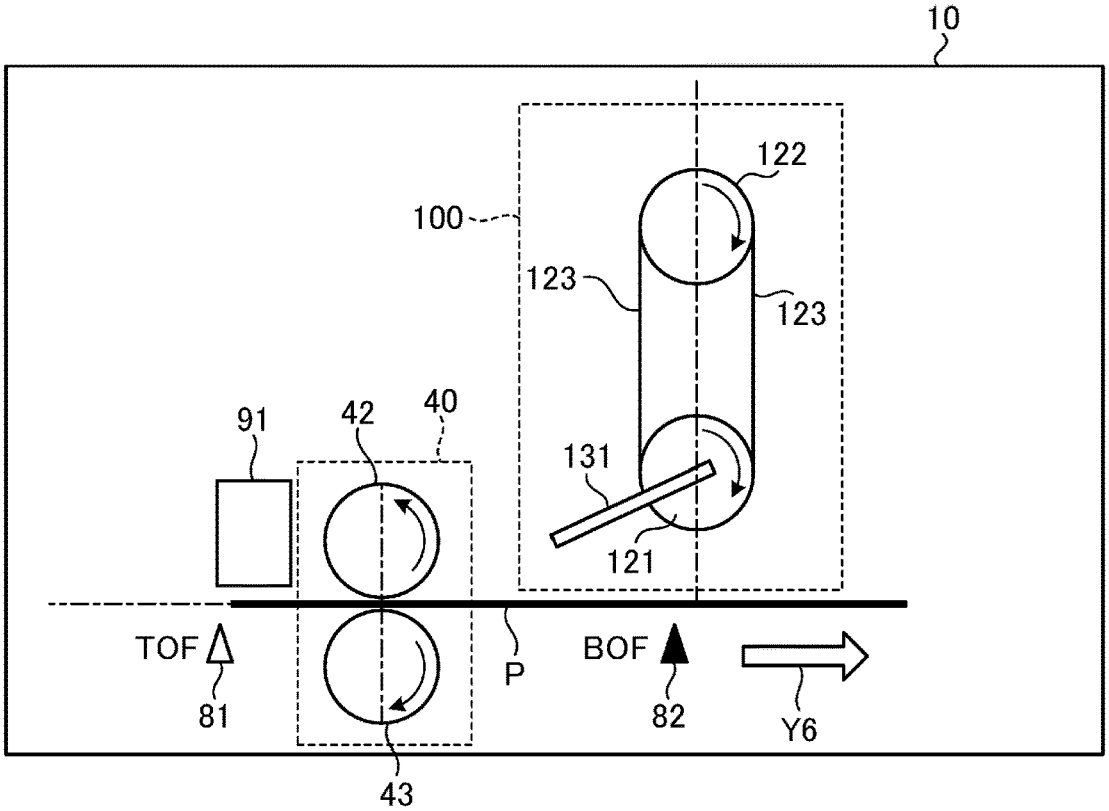
FIG. 17 is a diagram illustrating a state where the check turned upside down is located at the printing position in the printer in a state where the front surface of the check is directed upward.

FIG. 17 is a diagram illustrating a state where the check P of which printing is performed on the front surface is discharged from the medium entrance and exit 12 to the outside of the housing 11. In FIG. 17, the conveyance unit 201 rotates the feed roller 42 and the pinch roller 43 backward, conveys the check P of which printing is performed on the front surface, in a direction indicated by an arrow Y6, and then discharges the check P from the medium entrance and exit 12 to the outside of the housing 11.

When the control unit determines that double-sided printing is not performed (No in ACT 33) in ACT 33, the control unit 200 performs printing on the back surface of the check P conveyed on the backward path, in accordance with printing data (ACT 44). Then, the control unit performs the process of ACT 43.

According to such an embodiment, the paper conveyance device 40 includes the conveyance unit 201 that conveys the long check P in the longitudinal direction, the measuring unit 202 that measures the length L of the check P in the longitudinal direction, which is conveyed by the conveyance unit 201, the reversal mechanism 100 that conveys the check P and reverses the front surface and the back surface of the check P to each other, and the reversal unit 205 that conveys the check P in the reversal mechanism 100. When the measuring unit 202 measures that the length L of the check P is less than the predetermined length, the reversal unit 205 conveys the check P at the first speed. When the measuring unit 202 measures that the length L of the check P is equal to or more than the predetermined length, the check P is conveyed at the second speed slower than the first speed.

According to the paper conveyance device 40 in such an embodiment, the check P is conveyed at the first speed when the length L of the check P is less than the predetermined length, and the check P is conveyed at the second speed slower than the first speed when the length L of the check P is equal to or more than the predetermined length. Therefore, in the paper conveyance device 40 in the embodiment, it is possible to reduce the processing time in the printer while preventing jamming.

According to such an embodiment, the printer 10 includes the conveyance unit 201 that conveys the long check P in the longitudinal direction, the measuring unit 202 that measure the length L of the check P in the longitudinal direction, which is conveyed by the conveyance unit 201, the first printing unit 203 that performs printing on the back surface of the check P with the printing mechanism 90, the reversal mechanism 100 that conveys the check P and reverses the front surface and the back surface to each other, the reversal unit 205 that conveys the check P of which printing is performed on the back surface by the first printing unit 203 in the reversal mechanism 100, and the second printing unit 206 that performs printing on the front surface of the check P turned upside down by the reversal mechanism 100, with the printing mechanism 90. The reversal unit 205 conveys the check P at the first speed when the measuring unit 202 measures that the length L of the check P is less than the predetermined length, and conveys the check P at the second speed slower than the first speed when the measuring unit 202 measures that the length L of the check P is equal to or greater than the predetermined length.

According to the printer 10 in such an embodiment, the check P is conveyed at the first speed when the length L of the check P is less than the predetermined length, and the check P is conveyed at the second speed slower than the first speed when the length L of the check P is equal to or more than the predetermined length. Therefore, in the paper conveyance device 40 in the embodiment, it is possible to reduce the processing time in the printer while preventing jamming.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the paper conveyance device 40 corresponds to the configuration obtained by excluding the MICR head 70, the inkjet head 91, the thermal head 92, the receipt conveyance motor 93, and the communication unit 35 from the printer 10. However, the embodiment is not limited thereto. The paper conveyance device 40 may include any component so long as the paper conveyance device includes a component that measures the length L of the check P, a component that determines whether the length L of the check P is equal to or more than or less than the predetermined length, and a component that reverses the front surface and the back surface of the check P to each other and conveys the check P at the first speed in the reversal mechanism 100 when the length L of the check P is less than the predetermined length at that time, and conveys the check P at the second speed slower than the first speed in the reversal mechanism 100 when the length L of the check P is equal to or more than the predetermined length.

The description is made on the assumption that the printer 10 in the embodiment includes a component of reading the MICR character. However, the embodiment is not limited thereto, and the printer 10 in the embodiment may not include a component that reads the MICR character.

In the embodiment, the inkjet head 91 is provided on an opposite side of the MICR head 70 with the conveyance path K interposed between the inkjet head 91 and the MICR head 70. However, the embodiment is not limited thereto, and the printing mechanism 90 and the MICR head 70 may be provided on the same side as the conveyance path K.

In the embodiment, the inkjet head 91 is used in the printing mechanism 90. However, the embodiment is not limited thereto, and the printing mechanism 90 may perform printing on the check P with a head (for example, wire dot head) other than the inkjet head 91.

In the embodiment, the check P is described as an example of cut paper. However, the embodiment is not limited thereto, and the cut paper may not be the check P, for example, a bill or a ticket.

In the embodiment, the description is made such that the speed of the check P being conveyed in the reversal mechanism 100 is set to the first speed or the second speed depending on whether the length L of the check P is less than, or equal to or more than the predetermined length. However, the embodiment is not limited thereto. The length L of the check P may be finely measured, and a plurality of types of predetermined lengths may be set. Thus, the check P may be conveyed at three or more types of speeds, for example, a third speed and a fourth speed in addition to the first speed and the second speed.

In the embodiment, the first printing unit 203 performs printing on the back surface of the check P, and the second printing unit 206 performs printing on the front surface of the check P. However, the embodiment is not limited thereto. The first printing unit 203 may perform printing on the front surface of the check P, and the second printing unit 206 may perform printing on the back surface of the check P.

What is claimed is:

1. A paper conveyance device, comprising:

a conveyance component configured to convey long cut paper in a longitudinal direction;

a measuring component configured to measure a length of the long cut paper in the longitudinal direction, which is conveyed by the conveyance component;

a reversal mechanism that reverses a front surface and aback surface to each other with conveying the long cut paper; and a reversal component configured to convey the long cut paper in the reversal mechanism, wherein the reversal component conveys the long cut paper at a first speed when the measuring component measures that the length of the long cut paper is less than a predetermined length, and conveys the long cut paper at a second speed slower than the first speed when the measuring component measures that the length of the long cut paper is equal to or greater than the predetermined length.

2. The paper conveyance device according to claim 1, further comprising:

a reversal determination component configured to determine whether or not it is required to reverse the front surface and the back surface of the long cut paper to each other, wherein the reversal component conveys the cut paper in the reversal mechanism, when the reversal determination component determines to reverse the front surface and the back surface of the long cut paper to each other.

3. The paper conveyance device according to claim 1, wherein the predetermined length is substantially equal to a distance of the long cut paper being conveyed in the reversal mechanism.

4. The paper conveyance device according to claim 1, wherein the long cut paper is one of a check and a ticket.

5. The paper conveyance device according to claim 1, wherein the long cut paper has a length larger than a width.

6. The paper conveyance device according to claim 1, wherein the long cut paper has a rectangular shape.

7. The paper conveyance device according to claim 1, wherein the long cut paper has magnetic ink thereon.

8. A printer, comprising:

a conveyance component configured to convey long cut paper in a longitudinal direction;

a measuring component configured to measure a length of the long cut paper in the longitudinal direction, which is conveyed by the conveyance component;

a first printing component configured to perform printing on one surface of the long cut paper with a printing mechanism;

a reversal mechanism that reverses a front surface and aback surface to each other with conveying the long cut paper;

a reversal component configured to convey the long cut paper of which the first printing component performs printing on the one surface, in the reversal mechanism; and a second printing component configured to perform printing on the other surface of the long cut paper turned upside down by the reversal mechanism, with the printing mechanism, wherein the reversal component conveys the long cut paper at a first speed when the measuring component measures that the length of the long cut paper is less than a predetermined length, and conveys the long cut paper at a second speed slower than the first speed when the measuring component measures that the length of the long cut paper is equal to or greater than the predetermined length.

9. The printer according to claim 8, further comprising:

a reversal determination component configured to determine whether or not it is required to reverse the front surface and the back surface of the long cut paper to each other, wherein the reversal component conveys the long cut paper in the reversal mechanism when the reversal determination component determines to reverse the front surface and the back surface of the long cut paper to each other, based on information to be printed by the second printing component.

10. The printer according to claim 8, further comprising:

a magnetic ink reader.

11. The printer according to claim 8, wherein the printer is an inkjet printer.

12. The printer according to claim 8, wherein the printer is a POS terminal.

13. The printer according to claim 8, wherein the predetermined length is substantially equal to a distance of the long cut paper being conveyed in the reversal mechanism.

14. The printer according to claim 8, wherein the long cut paper is one of a check and a ticket.

15. The printer according to claim 8, wherein the long cut paper has a length larger than a width.

16. The printer according to claim 8, wherein the long cut paper has a rectangular shape.

17. A paper conveyance method, comprising:

conveying long cut paper in a longitudinal direction;

measuring a length of the long cut paper in the longitudinal direction, which is conveyed;

reversing a front surface and a back surface to each other with conveying the long cut paper; and conveying the long cut paper in a reversal direction, wherein conveying the long cut paper at a first speed when the measured length of the long cut paper is less than a predetermined length, and conveying the long cut paper at a second speed slower than the first speed when the measured length of the long cut paper is equal to or greater than the predetermined length.

18. The paper conveyance method according to claim 17, further comprising:

determining whether or not it is required to reverse the front surface and the back surface of the long cut paper to each other, wherein conveying the cut paper in the reversal mechanism, when determining to reverse the front surface and the back surface of the long cut paper to each other.

19. The paper conveyance method according to claim 17, wherein the predetermined length is substantially equal to a distance of the long cut paper being conveyed in the reversal mechanism.

20. The paper conveyance method according to claim 17, further comprising:

printing on one surface of the long cut paper with a printing mechanism prior to reversing the front surface; and printing on the other surface of the long cut paper turned upside down with the printing mechanism after reversing the front surface.

* * * * *